United States Patent [19]

Ditton

[11] Patent Number: 4,821,880

[45] Date of Patent: Apr. 18, 1989

[54] PALLETIZED STRUCTURE CONTAINING SPOOLS

[75] Inventor: Louis G. Ditton, Fort Wayne, Ind.

[73] Assignee: Essex Group, Inc., Ft. Wayne, Ind.

[21] Appl. No.: 230,727

[22] Filed: Aug. 5, 1988

Related U.S. Application Data

[63] Continuation of Ser. No. 78,727, Jul. 27, 1987, abandoned.

[51] Int. Cl.[4] ..... B65D 19/00

[52] U.S. Cl. ..... 206/386; 206/389; 206/391; 206/597; 229/199; 229/919; 229/DIG. 2

[58] Field of Search ..... 206/386, 586, 597, 600, 206/389, 391, 395; 229/101, 199, 23 C, 919, DIG. 2, DIG. 5; 53/399, 443, 448

[56] References Cited

U.S. PATENT DOCUMENTS

| | | | |
|---|---|---|---|
| 1,704,118 | 3/1929 | Babcock | 229/23 C |
| 2,119,956 | 6/1938 | McDonnell | 206/597 X |
| 2,254,381 | 9/1941 | Mueller | 229/23 C |
| 2,454,573 | 11/1948 | Scher | 229/919 X |
| 2,514,587 | 7/1950 | Nugent | 229/919 X |
| 2,594,156 | 4/1952 | Guyer | 229/199 |
| 2,738,058 | 3/1956 | Hansen et al. | 206/597 |
| 3,036,752 | 5/1962 | Elliott | 206/386 X |
| 3,159,326 | 12/1964 | Stonebanks | 229/23 C |
| 3,306,517 | 2/1967 | Diesinger, Jr. | 229/199 |
| 4,033,455 | 7/1977 | Robinson | 206/391 |
| 4,096,987 | 6/1978 | Rodish | 229/DIG. 3 |
| 4,248,350 | 2/1981 | Gilbert | 206/586 |
| 4,391,371 | 7/1983 | Sieffert | 206/597 |
| 4,399,915 | 8/1983 | Sorenson | 206/586 |
| 4,426,015 | 1/1984 | Preston et al. | 206/386 X |
| 4,482,054 | 11/1984 | Gardner | 206/586 |
| 4,483,444 | 11/1984 | Gardner | 206/586 |

FOREIGN PATENT DOCUMENTS

| | | | |
|---|---|---|---|
| 0067656 | 12/1982 | European Pat. Off. | 206/391 |
| 2551726 | 3/1985 | France | 206/386 |

*Primary Examiner*—David T. Fidei

[57] ABSTRACT

A palletized structure for containing a plurality of wire spools or pails containing wire is disclosed. The palletized structure includes a formed cap structure with an integrally formed beam structure which preserves the rigidity of the cap structure when the palletized structure is subjected to motion and shock forces normally encountered in loading, shipping or storage of wire spools or pails. The cap structure retains the relative position of the spools or pails within the palletized structure.

6 Claims, 6 Drawing Sheets

PALLETIZED STRUCTURE CONTAINING SPOOLS

This is a continuation of Ser. No. 78,727 filed July 27, 1987, abandoned.

TECHNICAL FIELD

The invention relates to shipping containers, more particularly, the invention relates to containers utilized for containing a plurality of cylindrical objects most especially spools containing filaments or wire.

BACKGROUND ART

Although a seemingly trivial issue at first glance, the efficient and cost effective packing storage and shipping of wire and filaments is a problem of ever increasing importance. This is due to rising costs of manufacturing and packaging which contribute an ever increasing share to the cost of the overall product and, hence, increases the cost of the delivered wire or filaments which are wound upon to spools. In order to effectively package, store and ship wires and filaments, various apparatuses have been invented which exhibit unique benefits according to the nature of each individual invention. Attention is drawn to several of these including U.S. Pat. No. 2,594,287 to L. J. Budd for a "Pallet Container Assembly for Shipping Articles"; U.S. Pat. No. 2,628,715 to L. J. Budd for a "Palletized Shipping Structure"; U.S. Pat. No. 3,638,790 to Schmid et al for a "Palletized Packaging of Cylindrical Objects"; U.S. Pat. No. 4,516,677 to Rowland et al for a "Modular Pallet and Shipping Tray" and to U.S. Pat. No. 4,582,198 to the present inventor, Ditton for a "Wire Shipping and Dispensing Package".

These various inventions have solved unique and specific problems pertaining to the containment and transport of wires and filaments which may be contained in cylindrical packing containers or wound onto spools. However, as noted above, there remains an ever present and continuing need in the art to provide improved apparatuses and methods useful in packing, storing and shipping filaments and wires.

DISCLOSURE OF THE INVENTION

The present invention provides an improved palletized structure for containing a plurality of cylindrical objects, wherein each of said cylindrical objects has two ends and a body contained therebetween which comprises; a pallet which has a generally planar surface, a plurality of cylindrical objects each having a first end generally parallel to the generally planar surface of the aforesaid pallet, and the generally planar cap structure which is generally parallel with each second end of the said cylindrical objects, wherein the cap structure is characterized by at least one beam structure.

A further feature of the present invention is a cap structure suitable for use with a palletized structure for containing a plurality of cylindrical objects wherein each of said cylindrical objects has two ends and a body therebetween, and a pallet having a generally planar surface where the cap structure is characterized by at least one integral beam structure.

Another feature of the present invention is the provision of a method of containing a plurality of cylindrical objects, each of which of aforesaid cylindrical objects has two ends and a body therebetween within a palletized structure which comprises the method steps of:

providing a pallet having a generally planar surface, placing a plurality of cylindrical objects on the aforesaid pallet so that the first end of each cylindrical object is generally parallel to the generally planar surface of the pallet, providing a generally planar cap structure which is characterized by at least one beam structure, positioning the aforesaid cap structure to be generally parallel with each second end of the aforesaid cylindrical objects. This is further enhanced by providing at least one binding means preferably a plurality of binding means such as a band or cable formed of material having a sufficiently high tensile strength such as a metal or some plastics, and encircling the palletized structure with the said binding means.

Further objects and advantages of the disclosed invention will become more apparent by reference to the accompanying figures and the following description thereof.

BEST MODE FOR CARRYING OUT THE INVENTION

Figure 1:
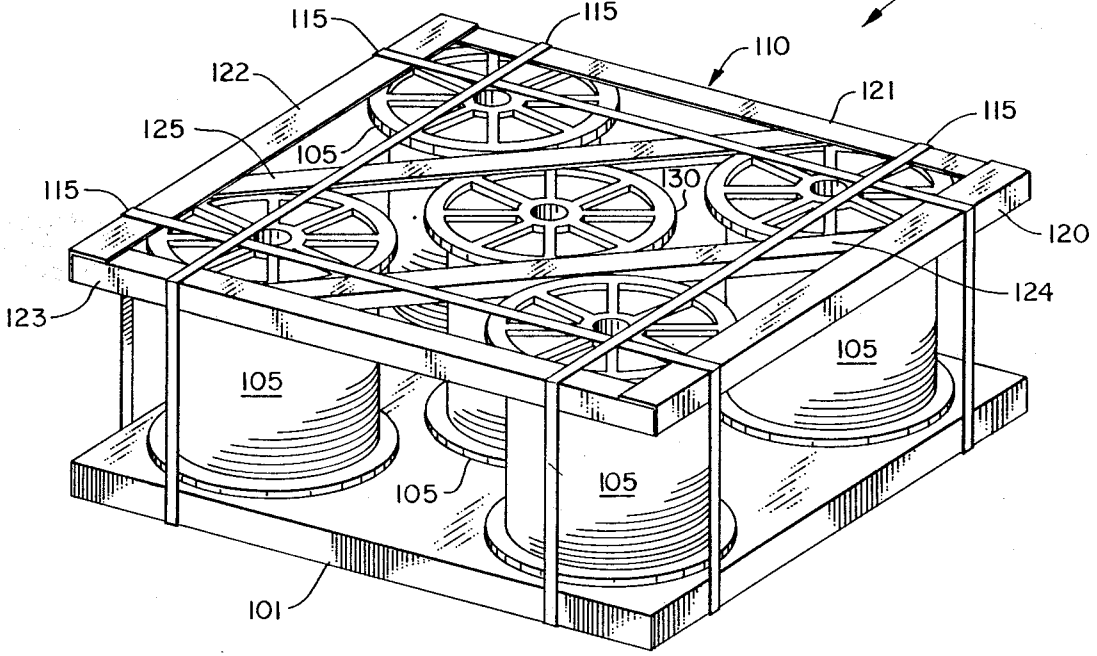
FIG. 1 PRIOR ART
FIG. 1 is a drawing of a prior art palletized structure useful for containing spools.

Turning now to FIG. 1 in the accompanying drawings, a prior art example of a cap structure utilized for containing a plurality of spools upon a palletized structure is illustrated. As shown, the pallet structure 101 supports a plurality of (here five spools) 105 upon which is positioned a cap structure 110. The cap structure 110 is maintained in position and fastened to the spools 105 and to the pallet structure 100 by a series of bands 115 which encircle the pallet structure 101, the spools 105 and the cap structure 110. Upon closer scrutiny it may be seen that the cap structure 110 itself is fabricated of six separate frame members 120, 121, 122, 123, 124, 125, wherein each of the frame members has a cross section in the shape of the letter "L" and is assembled so to first form an enclosing peripheral frame utilizing frame members 120, 121, 122, 123 so to maintain the position of the spools 105 nearest the margins of the palletized structure 101. Further, frame member 124 is diagonally attached to frame members 120 and 123 and frame member 125 is diagonally attached to frame 121 and 122 so to provide a diagonal support to the cap structure 110 and to provide a divider between the spools 105. Further, the frame members 124, 125 function to maintain the position of the central spool 130 so that in case of tipping of the complete palletized structure containing the spools, the central spool 130 will not dislodge itself from the palletized structure. It is readily by the arrangement of the cap structure 110, by the fact that the distance between the two diagonal members 124, 125 is positioned so to accommodate the ends of the spool, most notably the central spool 130.

Such a frame, although widely used, requires an extensive amount of hand assembly and is labor intensive and costly in materials. This is due to the nature of the frame itself wherein each of the frame members must be individually fabricated and assembled so to form a cap structure as illustrated in FIG. 1 which requires that the total size of the pallet structure 100 and the respective positions of the spools 105 thereon be considered in order to properly position the size and placement of the frame members 120, 121, 122, 123 and most especially the diagonal frame members 124, 125 during the fabrication process.

Turning now to the preferred embodiment of the which may be used to fabricate the most preferred embodiment of the invention is illustrated. This sheet of material may be any generally planar sheet of a material which has sufficient stiffness so that when the claimed invention is fabricated and the palletized structure is used in storage, shipping, transport, loading or other function normally associated in the handling of such palletized structure containing spools, the material does not fail or yield in case of tipping or normal dropping of the palletized structure. Satisfactory materials include cardboard, plywood, and planks which are formed, fastened or nailed to form a generally planar sheet. Most preferred, however, is corrugated cardboard which is preferred for several reasons. First, corrugated cardboard is readily available at a relatively low cost and is commonly used in shipping containers. Second, the corrugations which are incorporated in the corrugated cardboard provide sufficient support to the upper and lower sheets of paper which are used in the fabrication of corrugated cardboard. Third, the direction of the corrugations form "ribs" which when utilized in accordance with the following description of the most preferred embodiment of the invention, and with the other embodiments of the invention, are beneficial and facilitate the proper functioning of the invention as the corrugations provide additional stiffening strength so to resist flexure, or breaking of the cap structure when the invention is used. Additionally, corrugated cardboard comes in a variety of breaking strengths which allow for the invention to be practiced within a wide range of applications in an economical fashion, to wit, a corrugated cardboard sheet may be used wherein a low breaking strength is selected due to the relatively smaller sizes or weights of the "cylindrical objects", i.e. spools or pails containing wire or other filaments, are used. Conversely when larger cylindrical objects, are used a sheet of corrugated cardboard having a higher breaking strength may be selected so to assure that the invention will function properly during normal storage, shipping, transport, loading or other functions to which such palletized shipping structures are normally subjected.

Referring now again to FIG. 2*a*, a sheet of material 200 is shown. Two lines 210, 220, also known as "upper fold lines", illustrate the relative location wherein the cardboard is to be scored. Lines 230, 240 illustrate the relative locations of "lower fold lines" wherein the corrugated cardboard is to be scored. What is meant by scored in this context is that the sheet of cardboard is to be either sufficiently creased, crimped, bent or partially cut so to allow the sheet to be folded at the location of these lines. More preferably, the sheet of material should be partially cut so that the surface at which the cutting means, such as a knife blade or rotary knife will extend downward and into the sheet of material deep enough to assure partial separation but deny the total separation, or total "cutting through", of the sheet of material. This assures that the cuts along the upper fold line 210, 220, or the lower fold line 230, 240 form a distinct line along which the sheet of material may be folded. In cutting the sheet of material it is preferred that the upper fold lines 210, 220 be cut from the same surface of the sheet of material and that the lower fold lines 230, 240 be cut on the opposite side of the sheet of material. Most preferably, the direction of these upper fold lines 210, 220 and lower fold lines 230, 240 are to be in an orientation collinear to the direction of the corrugations within the corrugated cardboard which is utilized as the sheet of material. This assures that the corrugations provides additional stiffness and support to the beam structure which will be integrally formed, as will become apparent from the further description of the invention.

Figure 2A:
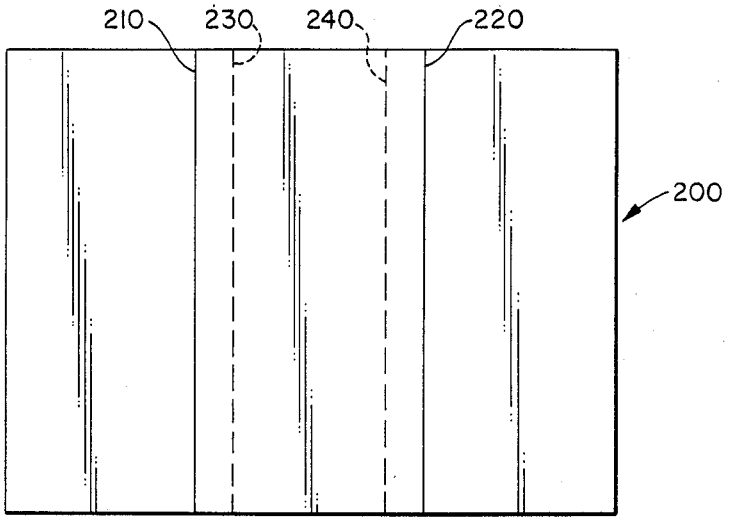
FIG. 2*a* is a top view of a sheet of material from which the most preferred embodiment of the present invention will be formed.
Figure 2B:
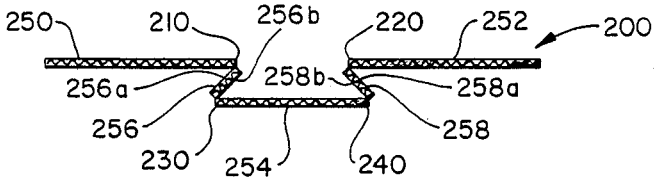
FIG. 2*b* is an end view of the most preferred embodiment of the invention showing the manner in which the cap structure is formed.

Turning now to FIG. 2*b*, an end view of the sheet of material of FIG. 2*a* is illustrated. As shown, the sheet of material is folded along the upper fold lines 210, 220 and the lower fold lines 230, 240 so to form five distinct "portions" from the sheet of material 200. These include two "side portions" 250, 252, a "central portion" 254 and two "reinforcing portions" 256 and 258 which are located between and joined to the central portion 254, to the side portions 250, 252. As illustrated in FIG. 2*b*, the side portion 250 and reinforcing portion 256, and side portion 252 and reinforcing portion 258 are folded in a common direction relative to the central portion. This assures that the integrally formed beam structures will be formed in an orientation mutually common to both side portion 250 and side portion 252. A fastening or adhesive means may now be incorporated into the fabrication of the invention. Any adhesive suitable for joining together the sheet of material, here glues for fastening corrugated cardboard may be used. The adhesive should be disposed upon the opposite surfaces of both reinforcing portions notably 256*a* and 256*b* of reinforcing portion 256 and 258*a* and 258*b* of reinforcing portion 258. This ensures that when the cap structure is totally assembled, the reinforcing portions 256, 258 are laminated or bonded to sections of each side portion 250, 252 and to the central portion 254.

Additionally, alternative fastening means may be simultaneously used, or substituted for the adhesive. Such fastening means include staples or adhesive tapes, especially "double-sided" tapes which have adhesives disposed on opposite surfaces and disposed upon the surfaces where the adhesive is normally used.

Figure 2C:
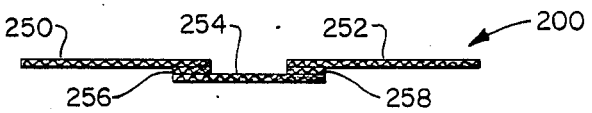
FIG. 2*c* is an end view of the most preferred embodiment of the invention in a completely assembled form.

Looking now to FIG. 2*c*, an end view of a completely assembled cap structure is illustrated. As shown, the cap structure 200 includes the side portion 250 laminated or fastened to the reinforcing portion 256 which is in turn laminated to central portion 254. Further, side portion 252 is laminated to section 258 and is in turn laminated to central portion 254. The region of the side portions 250, 252, reinforcing portions 256, 258 and central portion 254 which are layered in register due to the fabrication of the cap structure in accordance with the invention form two "integrally formed beam structures". The term "integrally formed" in used to mean that the sheet of material may be fabricated so to form a beam structure without the addition of any other material or structure.

As readily observable from FIG. 2*c*, the side portions 250, 252 in this most preferred embodiment of the invention are coplanar, whereas the central portion 254 occupies a parallel but non-coplanar orientation with respect to the side portions 250, 252. Although this is preferred this is not necessary for the successful operation and enjoyment of the present invention and the direction of the folds illustrated in FIG. 2*b* might be modified so to produce a cap structure which is not wholly in accordance with the illustration of FIG. 2*c* and which remains within the confines of the present invention.

Figure 2D:
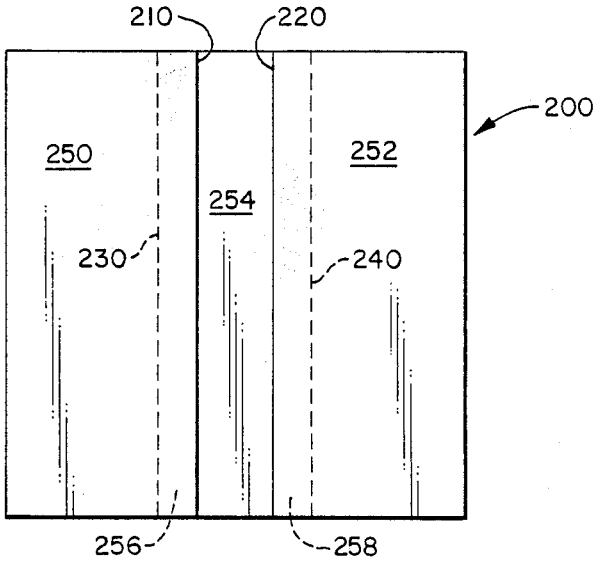
FIG. 2*d* is a top view of the cap structure according to the most preferred embodiment of the invention in a completely assembled form.

Turning now to FIG. 2*d* the top view of the present invention as shown in the end view of FIG. 2*c* is illustrated. As seen from FIG. 2*d*, the side portion 250 overlaps reinforcing portion 256 which is defined by the upper fold line 210 and the lower fold line 230, here shown as a dotted line. In turn, the reinforcing portion 256 is joined to the central portion 254 which is partially occluded by side portion 250 and which itself is joined in turn to reinforcing portion 258 is bonded by upper fold line 250 and lower fold line 240 as indicated by the dotted line. As with reinforcing portion 256, which is occluded by side portion 250, side portion 252 occludes reinforcing portion 258. As shown, the two side portions 250, 252 are approximately equal in area and are larger than central portion 254. It can further be seen in FIG. 2 that the beam structure is of a width of less than one third the width of the cap structure. This is done to minimize any waste of the sheet of material utilized to form the cap structure 200. Furthermore, the material comprising the fold line, and connecting the folded elements, operates as a stiffening shear structure in the beam structure. Limiting the width of the multiple thickness fold establishes the stiffening shear structure close to the center where the load will be imposed. It therefore contributes to stiffness at the desired location. However, the relative area is not critical to the correct operation of the present invention. Further, as shown on FIG. 2*d* the two reinforcing portions 256, 258 are also shown to be substantially equal in area relative to one another and to be substantially smaller in area than either the central portion 254 or either of the side portions 250, 252. Again the relative areas are not critical to the proper functioning of the invention and may be varied to suit the specific application to which the invention is ultimately applied. As a general rule, however, the sum of the areas of the reinforcing portions 256, 258 should be approximately equal to or less than that of the area of the central portion 254. This is to minimize wastage of material. Further, each of the side portions 250, 252 should be at least as large as the central portion 254, but preferably larger, once again to assure minimum wastage of material. The overall size of the cap structure 200 should be approximately equal in dimension to the size of the pallet with which the invention is to be ultimately used.

Figure 3:
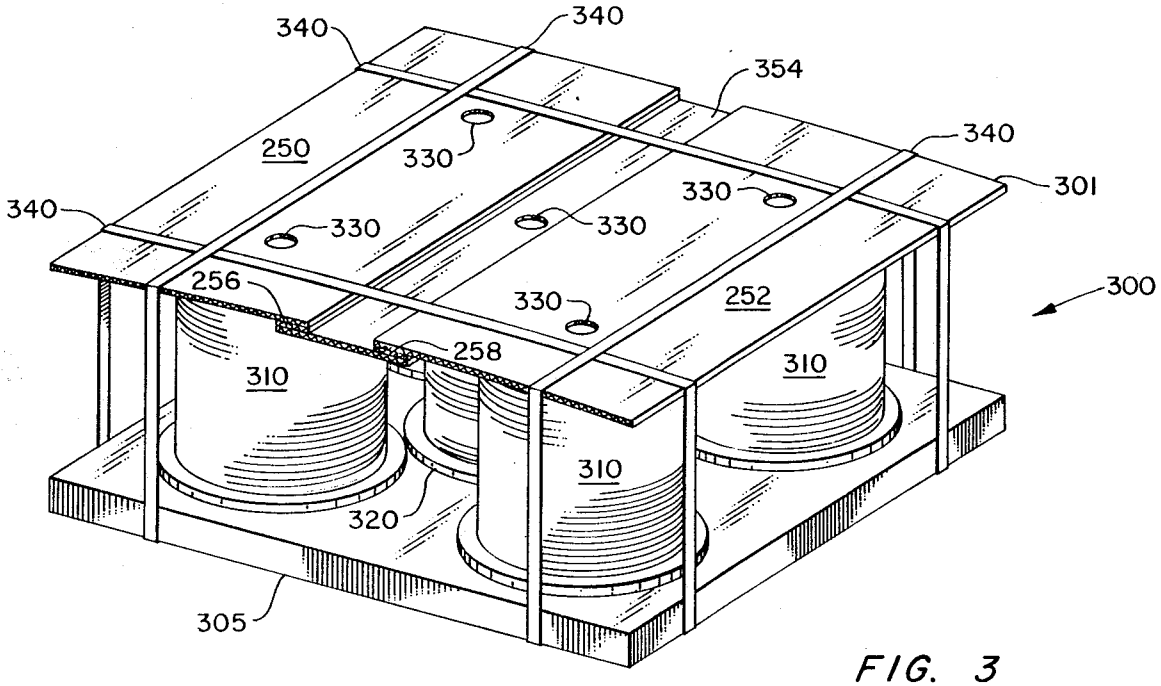
FIG. 3 is a perspective view of the most preferred embodiment of the invention incorporating a plurality of spools in a palletized structure as according to the claims of the present invention.

Turning now to FIG. 3, a palletized structure 300 including a cap structure 301 in accordance with the most preferred embodiment of the invention is illustrated. As shown, a pallet 305 supports five cylindrical objects having two ends and a body therebetween. Here the cylindrical objects are, five spools, four peripheral spools, 310 and one central spool 320 which is located between the peripheral spools 310. One end of each of the spools 310, 320 is placed upon the upper surface of the pallet 305 (which is a generally parallel structure), and there the cap structure 301 is placed upon the opposite ends of each of the spools 310, 320. As illustrated in FIG. 3, the central portion 354 is positioned upon the center of the central spool 320. Additionally, the width of the central portion 354 is less than that of the diameter of the central spool 320. Notably, this width is preferably less than half to half of the total diameter of the end of the central spool 320. This width has been found satisfactory for the operation of the present invention and while providing sufficient stiffness to the cap structure 301 minimizes the excess use of material here corrugated cardboard, of which the cap structure 301 is formed. As noted, it may be seen that the direction of the central portion 254, reinforcing portions 256 and 258, and side portions 250 and 252 are in a direction collinear to that of the direction of the corrugations within the sheet of cardboard used. This may be seen from FIG. 3.

Additionally, apertures 330 may be cut into or alternately, totally through, the cap structure 301 at the expected locations of the centers of each of the cylindrical objects, here spools, when they are placed upon the pallet 305. The function of these apertures may facilitate the loading of the pallet 305 and proper placement of the cap structure 301 in assuring that the center of the respective spools are properly located upon the pallet 305. These apertures may cooperate with a spool positioning means which may be an article such as a cap, or any other structure which may be affixed, or attached and protrude or extend beyond the end of the spool or cylindrical object. Conversely, spool positioning means may be extended through the apertures 330 into the center of each spool 310, 320 so to provide some locator or positioning means of the cap structure 301 relative to the aforesaid spools 310, 320 nd to retain the spools 310, 320 in their respective positions. Further, a plurality of encircling bands 340 as shown on FIG. 3, are used to encircle and fasten together the palletized structure as illustrated. These bands may be any band, rope, cable, ribbon or strap which may be utilized to fasten together the palletized structure so as to resist the dislodging or dislocation of the pallet 300, the spools 310, 320 and the cap structure 301 and is most preferably a band of steel.

Figure 4:
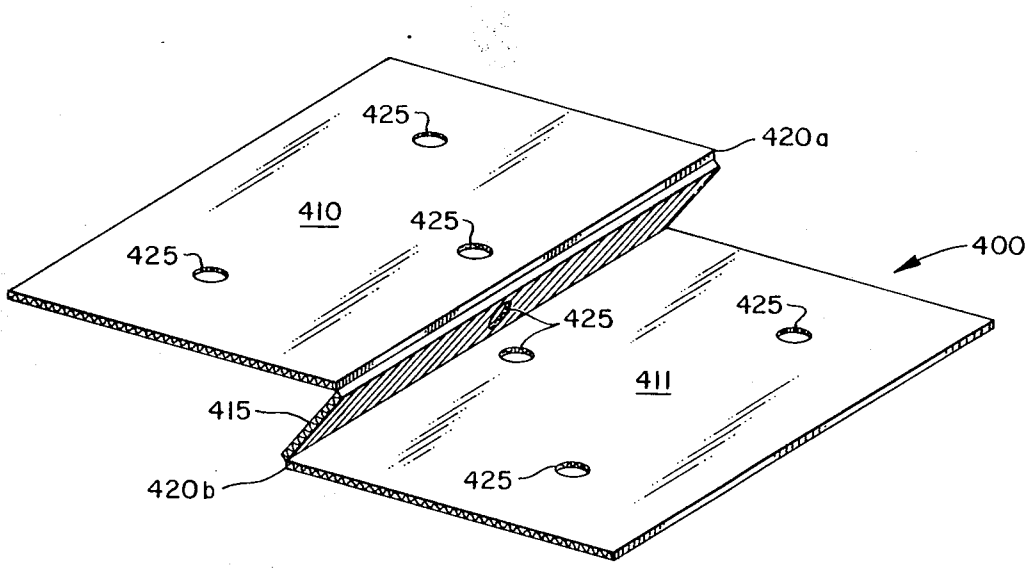
FIG. 4 shows an alternative embodiment of the invention.

An alternative embodiment of the present invention shown on FIG. 4. There the cap structure 400 is formed generally in accordance with the principles described in forming the cap structure 200 illustrated on FIGS. 2*a*, 2*b*, 2*c*, 2*d*. However, it should be apparent by simple observation of the drawings that the cap structure 400 of FIG. 4 is to ultimately form a cap structure 400 having a single integrally formed beam. As shown, the two end flaps 410, 411 and a reinforcing portion 415 are formed by folding a sheet of material along an upper fold line 420*a* which is formed by bending, folding, crimping or scoring and along a similarly formed lower formed line 240*b*. The sheet of material may be folded at the upper fold line 420*a* and lower fold line 420*b* to form two distinct side portions 410, 411 and a single reinforcing portion 415 therebetween. An adhesive material or other bonding means may be disposed upon both surfaces of the reinforcing portion 415 and the structure assembled by folding the side portions 410, 411 and the reinforcing portion 415 in register with the side portion 410 and the side portion 411. In accordance with the aforementioned description alternative bonding means such as simultaneous or exclusive use of fastener means such as staples may be utilized satisfactorily. Further, apertures 425 may be formed within the cap structure 400 in order to facilitate the loading of the pallet or positioning of the spools in accordance with the description accompanying FIG. 3.

Figure 5:
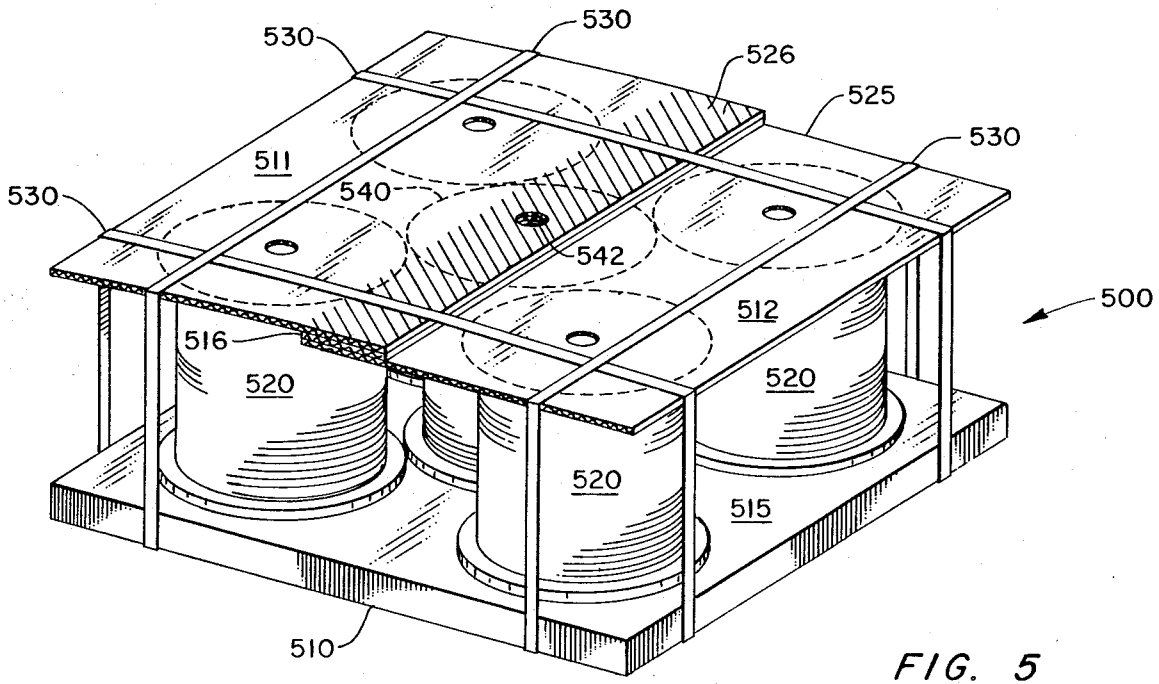
FIG. 5 is a perspective view of the utilization of the alternative embodiment of the invention and a plurality of spools and a palletized structure as according to the claims of the present invention.

FIG. 5 illustrates a palletized structure 500 having a pallet 510 with a generally planar surface 515, a plurality of generally cylindrical objects here spool 520, and a cap structure 525, wherein said cap structure 525, spools 520, and pallet 510, are assembled by use of a plurality of binding straps 530. As shown in FIG. 5, the integrally formed beam 526 is indicated by the hatched lines shown in FIG. 5 which illustrate the region of the two side portions 511 and 512 and the reinforcing portion 516 layered in register and fastened to form said integrally formed beam 526. Further, as shown, the position of the integrally formed beam coincides with the center of the central spool 540 at which location an aperture 542 is formed through the cap structure 525 and a spool positioning means extend so to engage the cap structure 525. Although the use of a cap structure is shown in FIG. 2 is preferred as it has been observed that dual integrally formed beams provide greater strength than the single integrally formed beam of FIG. 5, the cap structure of FIG. 5 is wholly suitable to the proper function of the invention and may be utilized.

Figure 6:
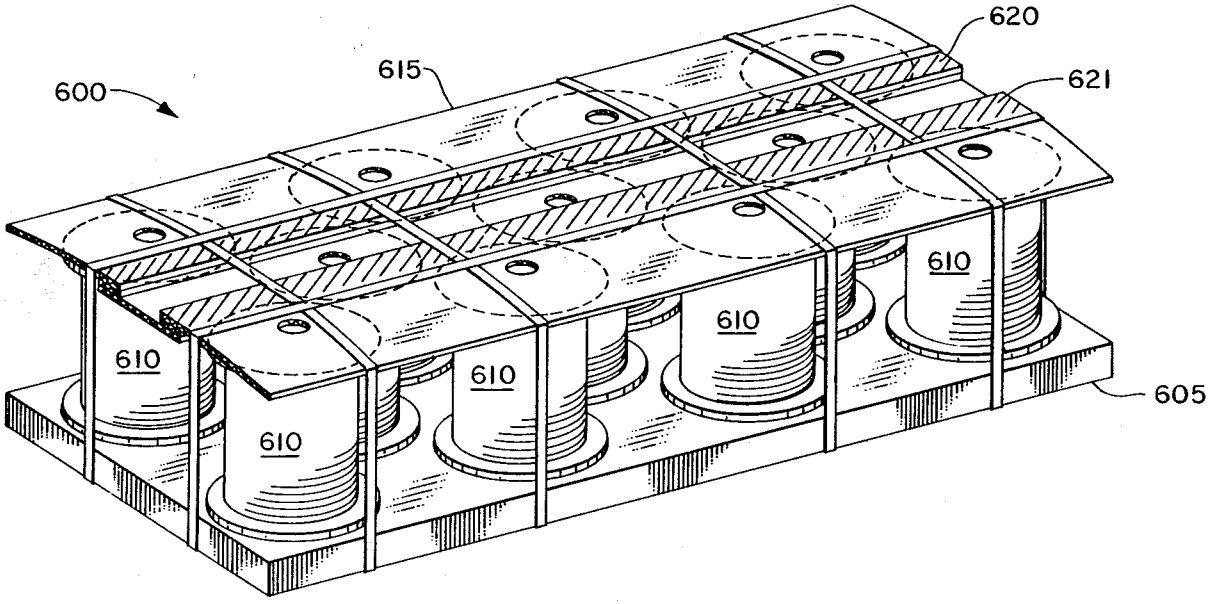
FIG. 6 is a further perspective view of the most preferred embodiment of the invention according to the claims.

FIG. 6 illustrates a palletized structure 600 according to the preferred embodiment of the present invention which includes a pallet 605, a plurality of cylindrical objects, here spools, 610 and a cap structure 615 which has two integrally formed beams 620, 621 which are illustrated by the hatched portions within this Figure. Although the geometry of the cap structure 615 varies from the geometry of the cap structures and sizes illustrated by FIGS. 1–5, it is noted that the present invention is adaptable to suit a wide variety of sizes and applications and yet provide the full benefits of the inventive concepts contained therein.

It is to be noted that to fully benefit from the utilization of the present invention, the location of the central portion of any cap structure of whatever embodiment should be located over the centrally located spool or spools, or cylindrical object or objects, positioned upon any pallet structure. This assures that when the pallet structure is transported and is subjected to various directional motions the spools, especially centrally located spools are retained by the rigidity of the integrally formed beams within the generally planar cap structure. This is further enhanced by utilizing the embodiments illustrated on FIGS. *2a*, *2b*, *2c*, *2d*, 3 and 6 as these embodiments incorporate to parallel integrally formed beams, which are relatively closely spaced in respect to each other and as such, provide reinforcing rigidity not only to the cap structure but to one another, as the palletized structure is subjected to forces which may induce flexure of the cap structure from a generally planar configuration.

As shown, the present invention provides a unique and cost effective method of solving a constant problem in the packing, transport and containment of wire spools while providing a low cost, the very effective structure. The structure may be readily preassembled, and requires a minimum of manual fabrication and/or handling, which consequently decreases the effective cost of the overall product wire as shipped through the effective reduction of shipping costs.

Further the structure may be used with alternative pallet structures, and not limited to the commonly utilized wooden pallet structures illustrated within this description, but may be used with any pallet-like structure which has at least one generally planar surface.

It should be noted that the additional integrally formed reinforcing beams will further increase the rigidity of the cap structure and are considered to be within the scope of the invention, as or to be other obvious variations of the present invention, and the description and specification made herewith is only by way of example and not limited as to the scope of the present invention.

I claim:

1. A palletized structure for containing a plurality of cylindrical objects, each of said cylindrical objects having two ends and a body therebetween comprising:

a pallet having a generally planar surface;

a plurality of cylindrical objects each having a first end generally parallel to be generally planar surface of said pallet;

a cap structure of corrugated cardboard which is generally parallel with and abutting each second end of said cylindrical objects characterized by at least one centrally located integral beam structure; and said integral beam structure formed of a multiple thickness fold of said cardboard having a length extending to the edges of said cap structure and a width of less than one third of the width of said cap structure.

2. A palletized structure as in claim 1 wherein the cap structure includes at least one spool positioning means located within said centrally located integral beam structure.

3. A palletized structure as in claim 2 wherein the said spool positioning means is an aperture.

4. A palletized structure as in claim 1:

said corrugated cardboard having directional corrugations; and said integral beam structure in an orientation collinear to the direction of said corrugations within said corrugated cardboard.

5. A palletized structure as in claim 4: said integral beam member comprising two triple thickness folds of said corrugated cardboard separated by an intervening single thickness of a width greater than the width of the fold.

6. A palletized structure as in claim 5:

said multiple thickness folds having parallel contacting portions; and said contacting portions adhesively secured to each other.

* * * * *